United States Patent [19]

Matsui et al.

[11] Patent Number: 4,914,349

[45] Date of Patent: Apr. 3, 1990

[54] PHOTO-ELECTRIC CONVERSION TUBE WITH OPTICAL FIBER PLATE

[75] Inventors: Toshikazu Matsui; Takeo Sugawara, both of Shizuoka, Japan

[73] Assignee: Hamamatsu Photonics Kabushiki Kaisha, Shizuoka, Japan

[21] Appl. No.: 112,490

[22] Filed: Oct. 26, 1987

[30] Foreign Application Priority Data

Oct. 27, 1986 [JP] Japan ..... 61-253712

[51] Int. Cl.[4] ..... H01J 1/78

[52] U.S. Cl. ..... 313/524; 313/532; 313/112; 350/96.27

[58] Field of Search ..... 313/524, 532, 541, 542, 313/544, 371, 372, 373, 384, 110, 112, 116, 103 CM, 105 CM; 350/96.27; 250/213 VT

[56] References Cited

U.S. PATENT DOCUMENTS

| | | | |
|---|---|---|---|
| 3,360,672 | 12/1967 | Marshall | 350/96.27 X |
| 3,586,895 | 6/1971 | Sowers et al. | 313/524 |
| 3,700,947 | 10/1972 | Goodrich et al. | 250/213 VT |
| 3,701,901 | 10/1972 | Suhami et al. | 313/532 X |
| 3,712,986 | 1/1973 | Collings | 313/524 X |
| 3,873,829 | 3/1975 | Evrard et al. | 313/524 X |
| 4,563,614 | 1/1986 | Howorth | 313/524 |

FOREIGN PATENT DOCUMENTS

| | | | |
|---|---|---|---|
| 37561 | 4/1974 | Japan . | |
| 46270 | 3/1980 | Japan | 313/532 |
| 181231 | 2/1970 | United Kingdom . | |

OTHER PUBLICATIONS

A. H. Sommer, "Photomissive Materials", 1968, pp. 232 and 233.

*Primary Examiner*—Donald J. Yusko
*Assistant Examiner*—Michael Horabik
*Attorney, Agent, or Firm*—Finnegan, Henderson, Farabow, Garrett and Dunner

[57] ABSTRACT

A photo electric conversion tube in which a translucent photocathode surface is provided inside of an incident light window. The incident light window is made of glass plate and an optical fiber plate bonded to at least part of the glass plate or just the optical fiber plate on the photocathode surface. The optical fiber plate contains fibers which are inclined at an angle to the photocathode surface.

10 Claims, 2 Drawing Sheets

FIG. 5

TABLE 1

| | PHOTO-ELECTRIC SURFACE QUANTUM EFFICIENCY T | | | | | | | | | | PHOTOMULTIPLIER TUBE SENSITIVITY |
|---|---|---|---|---|---|---|---|---|---|---|---|
| WAVELENGTH (nm) | 350 | 375 | 400 | 450 | 500 | 550 | 600 | 650 | 700 | 800 | AMPERES/LUMEN |
| WITHOUT FIBER PLATE | 21.5 | 23.0 | 23.0 | 20.0 | 16.0 | 12.0 | 9.0 | 6.0 | 4.4 | 1.5 | 140 |
| θ = 25° | 24.0 | 25.0 | 27.0 | 25.0 | 21.5 | 17.5 | 14.5 | 11.0 | 7.8 | 3.2 | 224 |
| θ = 50° | 22.5 | 24.0 | 26.0 | 24.0 | 20.5 | 17.0 | 13.5 | 10.5 | 7.5 | 2.8 | 208 |

FIG. 6

TABLE 2

| | QUANTUM EFFICIENCY OF PHOTO-ELECTRIC SURFACE T | | | | PHOTOMULTIPLIER TUBE SENSITIVITY |
|---|---|---|---|---|---|
| WAVELENGTH (nm) | 350 | 400 | 500 | 600 | AMPERES/LUMEN |
| WITHOUT FIBER PLATE | 24.5 | 27.5 | 23.8 | 7.8 | 227 |
| θ = 25° | 28.5 | 31.5 | 28.0 | 13.5 | 277 |
| θ = 50° | 27.0 | 31.0 | 27.5 | 14.5 | 247 |

PHOTO-ELECTRIC CONVERSION TUBE WITH OPTICAL FIBER PLATE

BACKGROUND OF THE INVENTION

This invention relates to a photo-electric conversion tube such as a photomultiplier tube or photoelectric tube.

In the prior art the vacuum container of a photoelectric conversion tube has an incident light window made of a transparent plate such as a quartz glass plate or borosilicate glass plate which can withstand the atmospheric pressure. Additionally, a translucent photocathode surface of antimony and alkali metal is formed on the inner wall (vacuum side) of the incident light window. In operation a light beam reaching the photocathode surface through the incident light window is absorbed by the photocathode surface, where it is converted into photoelectrons. The photoelectrons are emitted towards the vacuum side.

FIG. 1 shows an optical characteristic of a multialkali photocathode surface which is one example of the photocathode surface. In other words, FIG. 1 is a graphical representation indicating wavelength (λ) with absorption coefficient (k) for a multi-alkali photocathode surface. As is apparent from the graphical representation, the multi-alkali photocathode surface has a small absorption coefficient (k) in the range of long wavelengths, especially in an infrared range; that is, it cannot sufficiently absorb light in the range.

FIG. 2 is also a graphical representation indicating optical characteristics of photocathode surfaces; i.e., thicknesses (d) with absorption coefficients (k) with wavelengths (λ) as parameters. As is apparent from the graphical representation, when the thickness (d) of a photocathode surface is increased to increase the photoelectric conversion efficiency, the absorption coefficient is also increased. However, in this case, the distance between the place where photoelectrons are generated and the vacuum side increases, as a result of which some of the photoelectrons undergo recombination while moving towards the vacuum side, and the percentage of photoelectrons emitted into the vacuum; that is, the photo-electric conversion efficiency is decreased. Thus, the increase in thickness of the photocathode surface is limited.

For instance, an ordinary multi-alkali photocathode surface is 30 nm in thickness, and its absorption percentage of a light beam having a wavelength of 800 nm is 12%. And the distance for which photoelectrons generated move until they are recombined is about 15 nm, and therefore the quantum efficiency (a ratio of the number of photo-electrons to the number of incident photons) is 1.5% When a photo-electric conversion tube having the above-described characteristic values is employed as a scientific instrument, its S/N ratio is not so high.

As was described above, in the conventional photoelectric conversion tube, the photocathode surface cannot absorb an incident light beam because the thickness is limited, or the rate of emitting photoelectrons in the vacuum is low for the same reason.

SUMMARY OF THE INVENTION

A principal object of the invention is to provide a photocathode surface with a high rate of conversion of photons into photoelectrons without changing the thickness of the photocathode surface and thereby not decreasing the rate of emitting photoelectrons in the vacuum.

Another object of the present invention is to increase the absorption coefficient for a photocathode surface, especially for long wave lengths of light.

Still another object of the present invention is to provide a photo-electric conversion tube high in photoelectric conversion efficiency.

In a principal aspect of the invention a light beam incident to the photocathode surface through an optical fiber is inclined with respect to the photocathode surface.

To achieve the objects and in accordance with the purpose of the invention, as embodied and broadly described herein, the photo-electric conversion tube of the invention comprises an optical fiber plate covering at least a portion of said incident light window wherein optical fibers are oriented at an angle to said photocathode surface.

In summary, the means for solving the above-described problems is a photo-electric conversion tube in which a translucent photocathode surface is provided inside an incident light window, in which, according to the invention, at least a part of the incident light window is an optical fiber plate in which optical fibers are inclined with respect to the photocathode surface. That is, in the photo-electric conversion tube, the incident light window is made up of a glass plate and an optical fiber plate bonded to the incident side of the glass plate, or it is made up of the optical fiber plate only. In the latter case, photo-electric conversion material is vacuum-deposited on the inner surface (the vacuum side) of the optical fiber plate.

The accompanying drawings, which are incorporated in and constitute a part of this specification, illustrate one embodiment of the invention and, together with the description, serve to explain the principles of the invention.

DESCRIPTION OF THE DRAWINGS

In the drawings:

FIG. 5 is a table of photo-electric conversion efficident of the invention as applied to a first example;

FIG. 6 is a table of photo-electric conversion efficiencies of the invention as applied to a second example.

DESCRIPTION OF THE INVENTION

Figure 1:
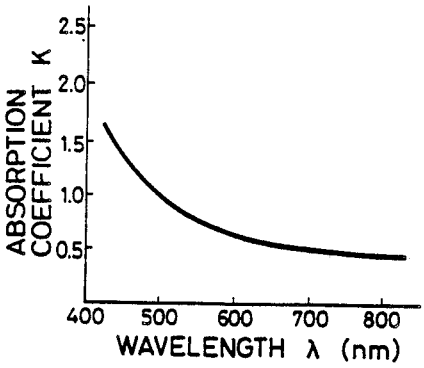
FIG. 1 is a graphical representation showing an optical characteristic of a photocathode surface; more specifically, wavelength (λ) with absorption coefficients (k) of a translucent multi-alkali photocathode surface.
Figure 2:
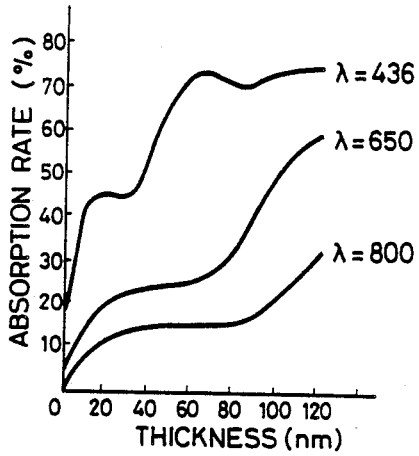
FIG. 2 is a graphical representation showing thickness (d) with absorption coefficients (k) of photocathode surfaces with wavelengths (λ) as parameters.
Figure 3:
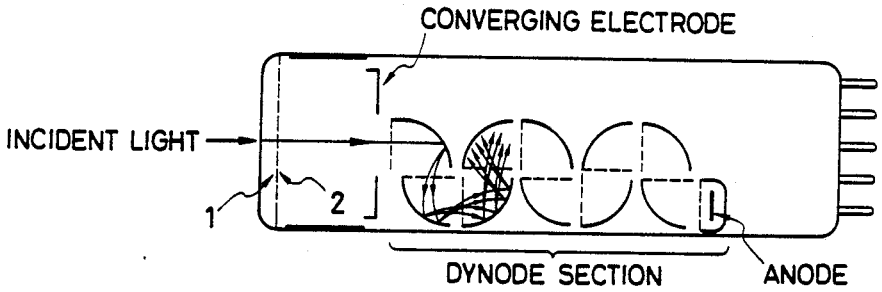
FIG. 3 is a schematic diagram showing a side view of an example of a photomultiplier of the present invention.
Figure 4:
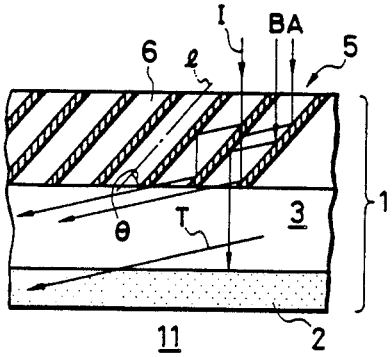
FIG. 4 is a cross sectional view showing a part of an incident light window in a photomultiplier according to the invention.

FIG. 3 is a schematic diagram showing a side view of an example of a photomultiplier according to the present invention and FIG. 4 is an enlarged explanatory diagram showing a part of an incident light window in the photomultiplier of FIG. 3.

In accordance with the invention, a photo-electric conversion tube in which a translucent photocathode surface 2 is provided inside an incident light window 1 as shown in FIG. 3, comprises an optical fiber plate covering at least a portion of the incident light window wherein optical fibers are oriented at an angle to said photocathode surface. Preferably, as shown in FIG. 4 the incident light window 1 of the photo-electric conversion tube comprises: a glass plate 3; and an optical fiber plate 5, 1 mm in thickness with optical fibers 6 having a diameter of 5 $\mu$n, optical fiber plate 5 being bonded to the incident light side of the glass plate 3 with a transparent adhesive. The axis l of each of the optical fibers 6 forms an angle $\theta$ with respect to the incident light window of less than 90° ($\theta$=25° or 50° in the embodiment). Antimony and a plurality of kinds of alkali metals are vacuum-deposited on the surface of the glass plate 3 which is on the vacuum side 11 of the container, to form a multi-alkali photocathode surface 2.

An incident light beam I applied to the photo-electric conversion tube reaches the photocathode surface 2 through an optical fiber 6 and the glass plate 3. As shown in FIG. 4, a light beam T incident to the photocathode surface 2 is inclined. Therefore, the optical path of the incident light beam T is long, and the rate of converting photons into photoelectrons is high. The incident angle of the light beam with respect to the photocathode surface 2 is maximum when it advances along an optical path A and minimum (0° )when it goes along an optical path B.

Photomultiplier tubes comprising a multi-alkali photocathode surface 30 nm in thickness formed in an incident beam window 1 having a diameter of 28 mm, and a box type dynode of ten stages conforming to the photocathode surface of the invention have been manufactured. In addition, a photomultiplier tube (R374 type manufactured by "Hamamatsu Photonics (phonetic)"), equal in construction to the above described photomultiplier tubes except that it has no optical fiber plate has also been manufactured. The photo-electric conversion characteristics of this tube type are as indicated in FIG. 5.

Photomultiplier tubes comprising a bi-alkali photocathode surface 30 nm in thickness formed in an incident light window 1 having a diameter of 28 mm, and a box type dynode of ten stages conforming to the photocathode surface of the invention have been manufactured. In addition, a photomultiplier tubes (R268 type manufactured by "Hamamatsu Photonics") equal in construction to the above-described ones except that it has no optical fiber plate has been manufactured. The photo-electric conversion characteristics of this tube type are as indicated in FIG. 6.

As is apparent from FIG. 5, at a wavelength of 800 nm at which the optical absorption efficiency is minimum, the quantum efficiency of the photomultiplier tube having the optical fiber plate in the incident light window is, at maximum, 2.1 times that of the photomultiplier tube having no optical fiber plate in the incident light window. Furthermore, as indicated in FIG. 5, even at a wavelength of 350 nm at which the optical absorption efficient is so large that the effect of the invention is considered small, the quantum efficiency of the photomultiplier tube having the optical fiber plate in the incident light window is higher by 20% than that of the photomultiplier tube having no optical fiber plate in the incident light window.

FIGS. 5 and 6 list the results of experiments given substantially in a range of visible rays to the photo-multiplier tubes each having the optical concept of the invention resides in that, when a light beam is obliquely applied to the photocathode surface, it is sufficiently absorbed by the latter, and the rate of emitting photoelectrons in the vacuum is not decreased. Therefore, when only the optical fiber plate is provided in the incident light window, then no unwanted optical reflection or scattering is caused between the optical fiber plate and the glass plate. Accordingly, the resultant photo-electric conversion tube is much higher in performance. Furthermore, the invention is more effective for infrared rays because the latter is more difficult to absorb than a light beam having a wavelength of 800 nm.

Figure 7:
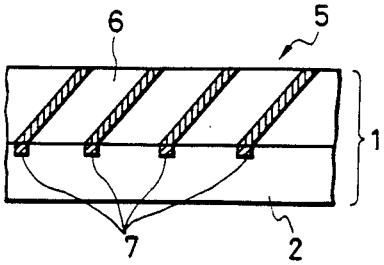
FIG. 7 is a cross-sectional view showing a modification of a part of the incident light window.

In order to increase light sensitivity, a plurality of electric conductive pieces 7 may be provided as shown in FIG. 7 in such a manner that the pieces 7 are positioned corresponding to claddings of the optical fiber plate. The plural conductive pieces 7 are electrically coupled to each other and they are maintained at the same potential.

In the photo-electric conversion tube of the invention, an incident light beam is obliquely applied to the photocathode surface. Accordingly, it is unnecessary to increase the thickness of the photocathode surface to increase the optical absorption efficiency of the photocathode surface; that is, the optical absorption efficiency is high, and the rate of emitting electrons in the vacuum is not decreased. Thus, the photo-electric conversion tube of the invention is high in photo-electric conversion efficiency. Furthermore, in the photo-electric conversion tube of the invention, the incident light window can be used, in its entirety, for the optical fiber plate. This will improve the quantum efficiency over the entire photocathode surface. The photo-electric conversion tube of the invention can be obtained merely by replacing the glass plate of the conventional photo-electric conversion tube with the incident light window described above. The invention can be considerably readily embodied by bonding the optical fiber plate to the incident side of the glass plate in the incident window. Thus, the invention can be readily applied to conventional photo-electric conversion tubes.

WHAT IS CLAIMED IS;

1. A photo-electric conversion tube comprising:

a tube container having an incident light window; and a translucent photocathode surface provided inside said incident light window having an absorption coefficient;

said incident light window including an optical fiber plate composed of a plurality of optical fibers for increasing the absorption coefficient of said photocathode surface and said optical fibers being fixed together in a parallel relationship and being oriented at an angle to said photocathode surface wherein said angle is less than 90 degrees.

2. A photo-electric conversion tube according to claim 1, wherein said optical fibers are bonded together in a substantially planar plate with one face of said optical fiber plate including light receiving ends of said optical fibers and the other face thereof including light emitting ends of said optical fibers.

3. A photo-electric conversion tube according to claim 2, wherein a glass is attached to said face of said optical fiber plate including light emitting ends.

4. A photo-electric conversion tube according to claim 2, wherein a plurality of electric conductive pieces are provided on said face of said optical fiber plate including light emitting ends in such a manner that said pieces are positioned corresponding to claddings of said optical fibers, said pieces being equal in potential.

5. A photo-electric conversion tube according to claim 3, wherein a plurality of electric conductive pieces are provided on the other face of said optical fiber plate in such a manner that said pieces are positioned corresponding to claddings of said optical fibers, said pieces being equal in potential.

6. A photo-electric conversion tube according to claim 1, wherein said angle is within a range from 25 degrees to 50 degrees.

7. A method for increasing the absorption coefficient of a photo-electric conversion tube, comprising the steps of:

bonding a plurality of optical fibers together to form an optical fibers plate;

attaching said optical fiber plate to said photo-electric conversion tube as an incident light window wherein said optical fibers are oriented at an angle of less than 90 degrees with respect to said photo-electric conversion tube;

providing a translucent photocathode surface inside said incident light window; and transmitting light through said light fibers to said photocathode surface at an acute angle with respect to said photocathode surface.

8. A method according to claim 7, wherein said step of attaching includes attaching said fibers at an angle between 25 degrees and 50 degrees relative to said photocathode surface.

9. A method according to claim 7 further comprising the step of providing a glass plate between said optical fiber plate and said translucent photocathode surface.

10. A method according to claim 9, wherein said step of attaching includes attaching said fibers at an angle between 25 degrees and 50 degrees relative to said photocathode surface.

* * * * *